United States Patent [19]

Echevin et al.

[11] Patent Number: 4,616,842

[45] Date of Patent: Oct. 14, 1986

[54] SKI

[75] Inventors: Michel Echevin, Meylan; Yves Piegay; Maurice Legrand, both of Voiron, all of France

[73] Assignee: Skis Rossignol S.A.-Club Rossignol S.A., Voiron, France

[21] Appl. No.: 599,450

[22] Filed: Apr. 12, 1984

[30] Foreign Application Priority Data

Apr. 12, 1983 [FR] France ..... 83 06252

[51] Int. Cl.[4] ..... A63C 5/075

[52] U.S. Cl. ..... 280/602; 280/809

[58] Field of Search ..... 280/602, 609, 610, 601, 280/809

[56] References Cited

U.S. PATENT DOCUMENTS

| | | | |
|---|---|---|---|
| 1,595,632 | 8/1926 | Taft | 280/601 |
| 3,820,802 | 6/1974 | Davis | 280/601 |
| 3,876,216 | 4/1975 | Wehr | 280/601 |
| 4,018,454 | 4/1977 | Burkart | 280/602 |
| 4,180,275 | 12/1979 | Montoya | 280/601 |
| 4,405,149 | 9/1983 | Piegay | 280/602 |
| 4,438,946 | 3/1984 | Piegay | 280/602 |

FOREIGN PATENT DOCUMENTS

| | | | |
|---|---|---|---|
| 2350656 | 10/1975 | Fed. Rep. of Germany | 280/602 |
| 587723 | 1/1959 | Italy | 280/601 |

*Primary Examiner*—David M. Mitchell
*Assistant Examiner*—Eric Culbreth
*Attorney, Agent, or Firm*—Karl F. Ross; Herbert Dubno

[57] ABSTRACT

An alpine ski has an independent element forming the shovel and tip of the ski, this element being secured to the front end of the ski body which is provided with a slightly upwardly turned transverse edge abutting a shoulder upon a rear part of this element where it is attached to the ski.

4 Claims, 6 Drawing Figures

SKI

FIELD OF THE INVENTION

Our present invention relates to a ski and, more particularly, to an Alpine-type ski having a tip (blade/-shovel or spatule) which is fabricated separately from the body of the ski.

BACKGROUND OF THE INVENTION

Skis in general, and Alpine skis, in particular, comprise a ski body extending from the tip at the leading end to the rear end and forming a running surface on the underside of the ski and an upper surface upon which ski bindings can be mounted.

Along its length, the ski is divided into three zones, namely, a forward zone which is frequently referred to as a shovel or toe of the ski, terminating in a somewhat upwardly turned tip, a central zone extending over most of the length of the ski and upon which the bindings are mounted, and a rear zone running to the rear end of the ski and generally referred to as the tail.

The shovel zone of the ski generally has a surface which diminishes in area in the forward direction, i.e. converges toward the tip which can be more or less pointed, more or less upwardly directed or raised or more or less rounded depending upon the ski design.

Invariably, however, the tip or end of the shovel portion of the ski is located substantially above the running surface of the ski and generally above the snow upon which the ski rides. The shovel, therefore, does not contribute significantly to the sliding support of the ski on the snow. It is however, necessary to allow the ski to ride over irregularities in the snow surface and to prevent crossing of the skis in use.

Because this shovel portion of the ski is located largely above the ski surface and has a comparatively large rigid mass, this mass is suspended or supported in a cantilever fashion upon a portion of the ski in constant contact with the snow surface and contributes an inertial mass which plays a significant role in the amplitude of vibrations generated in the body of the ski and excited by the multiple shocks and impacts generated during use of the ski.

In recent years there has been considerable concern with such vibrations insofar as they affect skiing comfort, control and ease of skiing (see U.S. Pat. Nos. 4,405,149 and 4,438,946, for example).

Because of its form and rigidity, the shovel portion of a conventional ski may be dangerous to use, i.e. the tip may represent a weapon capable of causing injury, especially because of the significant degree to which it projects upwardly. Furthermore, the shovel portion of the ski is a particularly sensitive part thereof because the ski body generally tapers in thickness towards this part so that fabrication of the ski is complicated in this region, and this region may represent the most fragile portion of the ski, especially in modern skis which are generally laminated from numerous layers of different materials. Bonding of these layers together is often a problem, particularly in the curved region of the shovel portion of the ski.

OBJECTS OF THE INVENTION

It is the principal object of the present invention to provide an improved ski without the disadvantages enumerated above.

Another object of this invention is to provide an improved shovel portion of an Alpine ski which produces a reduced vibration contribution, can be constructed more simply and has a reduced tendency toward breakage.

SUMMARY OF THE INVENTION

These objects, and others which will become apparent hereinafter, are attained, in accordance with the present invention in a ski whose central zone terminates at its leading end in a transverse edge located at the free end of a short slightly arcuate (upwardly curved) zone. The shovel portion of the ski of the invention is constituted by a light element which is fabricated independently of the body of the ski previously described, is profiled so as to have a curvature in the longitudinal dimension of the ski and which is fixed to this free end of the central zone to abut the aforementioned end and to extend the central zone to the tip of the ski.

This additional element, therefore, truly constitutes the shovel of the ski. For the desired degree of lightness and economy of manufacture, it has been found to be advantageous to fabricate it of a molded synthetic resin, for example an elastomeric material, a thermoplastic material or a thermohardening (thermosetting) material. It can be constituted as a unitary or one-piece body, i.e. a monoblock or can be constituted of a plurality of parts assembled in a fixed relationship to one another or even in a movable relationship to one another. In the latter case the relative adjustment of the parts can serve to extend the length of the shovel, i.e. to move the tip further away from the binding, to raise the tip or, conversely, to lower the tip and/or move the tip closer to the binding (i.e. reduce the effective length of the shovel portion).

For attachment of this element to the body of the ski, we may use any conventional means common for attachment to skis, namely adhesive bonding and glues of any conventional type, screws, rivets, etc.

Depending upon the configuration of the element, the material from which it is composed, and the manner by which it is attached to the ski body, it is possible to achieve one or more of a number of advantages, including:

a significant reduction in the mass of the shovel portion of the ski, and hence in the amplitude of vibrations of the ski;

increased safety for the skier because the shovel portion can be relatively supple, and thus possesses less tendency to lodge in the snow, and less danger to others because such supple shovels and tips cannot act as weapons;

a significant simplification in fabrication of the skis because the independent element can be easily made by molding and attached simply to the ski body which, because it need not possess directly the significantly curved shovel, can be made by lamination techniques with greater ease;

the possibility of increasing the variety of ski shapes, colors and esthetic presentations because the shovel element can be of different forms, colors and decorative contributions to the ski so that they can be utilized for identification of the ski type, ski size, individual ownership or any other purpose; and in the event of breakage of the element, the broken part can be removed and the element can be replaced on the body of the ski with comparative simplicity.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
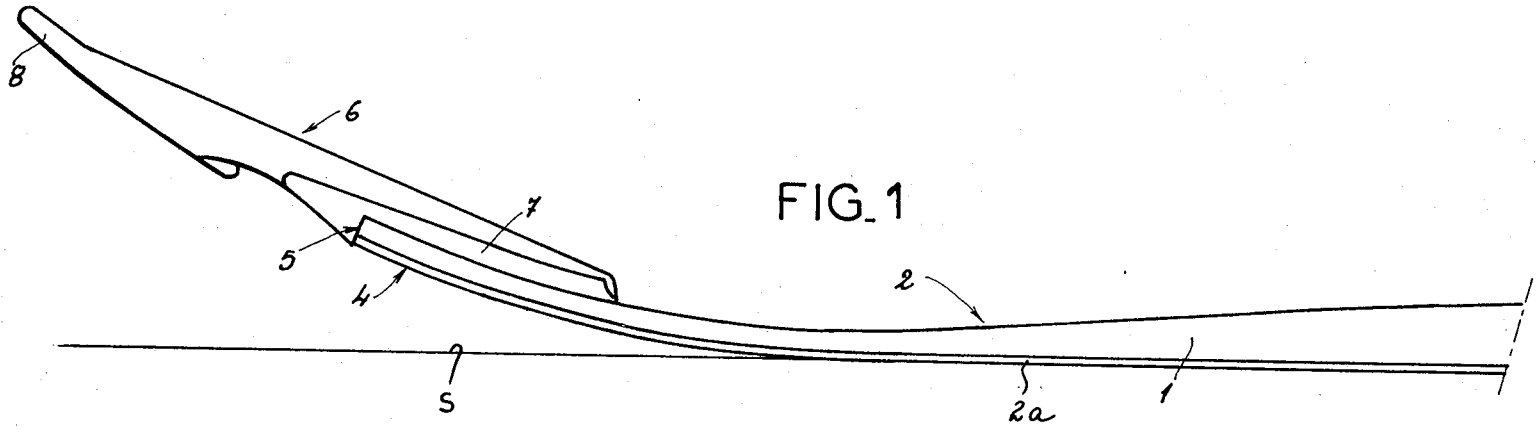
FIG. 1 is a side elevational view of the front portion of a ski body showing the shovel element of the invention in place.
Figure 4:
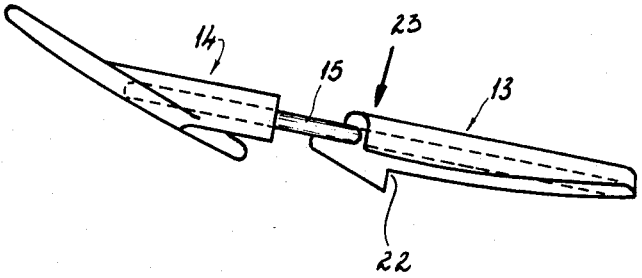
FIG. 4 is a side elevational view of another element adapted to be affixed to the end of a ski body.

In FIGS. 1 and 4 we show a ski body 1 which can be of any conventional form and can be generally the laminated ski body of an Alpine ski having a running surface 2*a* which can be seen beneath the central portion 2 of the ski. The latter is provided with ski bindings and has a conventional tail neither of which have been shown.

According to the invention, the central portion 2 merges into the beginnings of a shovel portion represented at 4 and having a slight upward curvature in the longitudinal direction to terminate in a transverse edge 5, here an edge which extends perpendicular to the longitudinal edges of the ski. In this respect the shovel portion differs from the shovel portions unitarily provided on such skis in accordance with conventional teaching in that the zone 4 is extremely short and is only a fraction of the length of the shovel portions normally provided and does not define the tip of the ski. It is also less upwardly curved than a conventional shovel portion. However, the rectangular transverse edge 5 lies slightly above the surfaces upon which the ski rests as can be seen from FIG. 1. In practice, the distance of the edge 5 above the surface S can be 10 to 25 mm.

Figure 3:
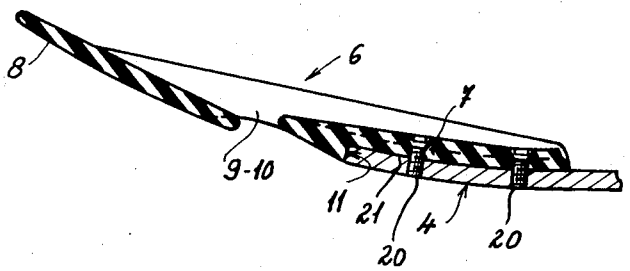
FIG. 3 is a section through this element taken along the line III—III of FIG. 2, but illustrating its junction with the leading end of the ski body.
Figure 2:
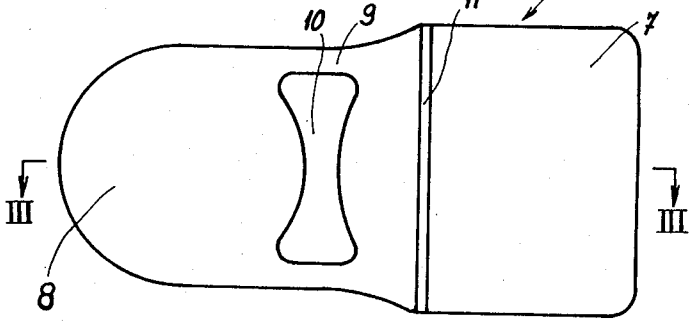
FIG. 2 is a plan view of this element.

This end of the ski is extended, according to the invention, by an independent element 6 which plays the true role of the shovel of the ski. This element 6 is constituted by a relatively supple or yieldable material. In the embodiment shown in FIGS. 1–3, the element 6 is a uniblock formed by molding and has a longitudinal curvature which extends and accentuates the curvature of the zone 4 of the ski.

This element has a rear portion 7 of rectangular configuration and a leading portion 8 having at least a semicircular outline and referred to as a generally circular element hereinafter. The generally circular zone is connected to the rear zone by an intermediate zone 9 formed with a window 10 serving to lighten the structure, i.e. to reduce its mass.

The rear portion 7 is formed on its underside with an indentation 11 into which the zone 4 of the ski body 1 fits flush with the edge 5 abutting a shoulder of this indentation. The width of the rear portion 7, i.e. its dimension transverse to the longitudinal dimension of the ski but parallel to the broad surfaces thereof is identical to that of zone 4 so that the element 6 is flush, not only at its underside, but also at its longitudinal edges with the body 1. The element 6 is attached to the zone 4 by screws 20 and a layer of adhesive 21.

The attachment of the element 6 to the zone 4 of the ski provides at the front end of the ski a true shovel because the circular zone 8 and the intermediate zone 9 constitute rigorous extensions of the riding surface 2*a* of the ski.

Figure 5:
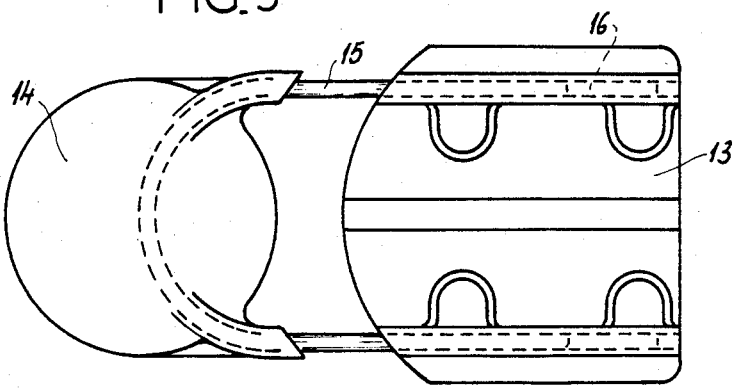
FIG. 5 is a plan view of this element.
Figure 6:
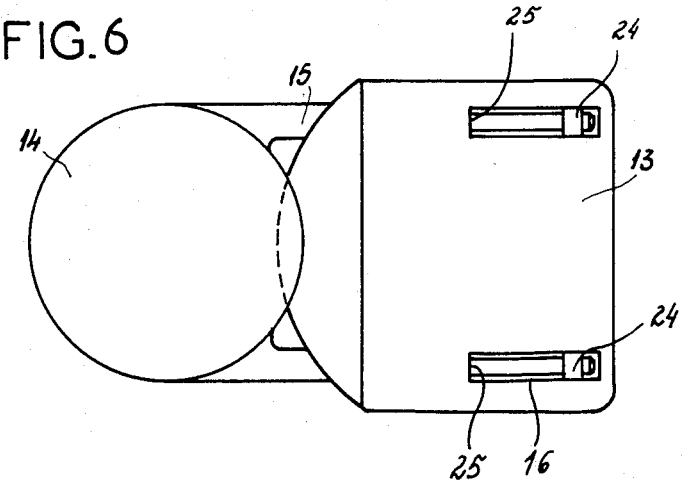
FIG. 6 is a plan view similar to FIG. 5 showing the element from the other side but in a contracted position.

In the embodiment of FIGS. 4–6, in which the indentation 22 can be seated on the leading edge of the ski body 1 in the manner described, the shovel element 23 consists of three parts and two distinct portions including a rear portion or base 13 which need not be fabricated of a supple material and can be affixed to the ski body in the manner described being provided with indentations, and a front portion 14 which is composed of a yieldable or supple material and is connected to the base 13 by a pair of shanks 15 formed from a bent rod molded into the circular portion 14. The shanks 15 are received in channels 16 formed by molding in the base 13 and are provided at their free ends with stops 24 which can engage walls 25 of the channels 16 to prevent complete retraction of the portion 14 from the base 13 unless the members 24 are broken off. Naturally, if the front portion 14 is damaged, the residue thereof can be withdrawn from the channel 16 by breaking away the members 24 and a new front portion can be inserted and new stops 24 applied through the openings of the channels 16 on the underside of the base 13. The shanks 15 slide with severe friction in the channels and can be adjusted to vary the effective length of the shovel between the extreme positions of FIGS. 5 and 6 which have been illustrated.

Naturally, the invention is not limited to the embodiments specifically illustrated, but embraces all variations as to fabrication, form and method of attaching the element to the ski within the spirit and scope of the appended claims.

We claim:

1. An alpine ski comprising an elongated ski body having a central portion terminating forwardly at an upwardly curved front end and terminating at the front end at a transverse leading edge, the body being primarily of a relatively dense and stiff material and having longitudinal edges;

a shovel-shaped element independent of the body and having a rear part formed with an indentation complementary to the transverse leading edge of the front end and an opposite tip, the element being continuous and primarily unitarily formed from the indentation to the tip of a material that is more supple and flexible than that of the body; and means fixing the element at the indentation to the leading edge of the front end against movement relative thereto, said element extending forward and upward from said indentation as an arcuate continuation of the front end of the body, the rear part being flush with the longitudinal edges of the body at the indentation where the element is secured to the front end of the ski body.

2. The ski defined in claim 1 wherein the fixing means is an adhesive.

3. The ski defined in claim 1 wherein the fixing means is screws securing the rear part to the front body end.

4. The ski defined in claim 1 wherein the fixing means secures the rear part.

* * * * *